US006322228B1

(12) United States Patent
Feldman

(10) Patent No.: US 6,322,228 B1
(45) Date of Patent: Nov. 27, 2001

(54) LAMP WITH ELECTROLUMINESCENT CONNECTORS TO POWER SOURCE

(76) Inventor: Harold Feldman, 137-47 76th Ave., Flushing, NY (US) 11367

( * ) Notice: Subject to any disclaimer, the term of this patent is extended or adjusted under 35 U.S.C. 154(b) by 0 days.

(21) Appl. No.: 09/223,142

(22) Filed: Dec. 30, 1998

(51) Int. Cl.[7] ..... F21V 9/16

(52) U.S. Cl. ..... 362/84; 362/251; 362/276; 362/395; 362/412

(58) Field of Search ..... 362/410, 414, 362/84, 802, 276, 310, 311, 412, 231, 251, 395, 551

(56) References Cited

U.S. PATENT DOCUMENTS

| | | | | |
|---|---|---|---|---|
| 3,069,579 | | 12/1962 | Berg et al. | 313/108 |
| 4,096,553 | | 6/1978 | Roche | 362/183 |
| 4,638,413 | | 1/1987 | Tarlow | 362/242 |
| 4,670,820 | | 6/1987 | Eddins et al. | 362/84 |
| 5,485,355 | | 1/1996 | Voskoboinik et al. | 362/84 |
| 5,733,035 | | 3/1998 | Spencer et al. | 362/128 |
| 5,763,872 | * | 6/1998 | Ness | 362/84 |
| 5,893,629 | * | 10/1999 | Gubernick | 362/84 |
| 5,967,649 | * | 10/1999 | Schlesinger | 362/84 |

* cited by examiner

*Primary Examiner*—Sandra O'Shea
*Assistant Examiner*—Ronald E. Delgizzi
(74) *Attorney, Agent, or Firm*—Abelman, Frayne & Schwab

(57) ABSTRACT

A light fixture is disclosed which combines one or more electroluminescent light sources with a light emitting bulb. The unit may function as a night light, and partake of various different configurations, including a table lamp or desk set.

21 Claims, 10 Drawing Sheets

LAMP WITH ELECTROLUMINESCENT CONNECTORS TO POWER SOURCE

FIELD OF INVENTION

The present invention relates to a light fixture which includes one or more electroluminescent light sources in the conductive path to the light emitting bulb. The electroluminescent light source may be selectively energized independent of, or in conjunction with, the light emitting bulb to provide a practical and aesthetically desirable night light.

BACKGROUND OF THE INVENTION

A variety of light fixtures are known which include a manually operable switch in conjunction with a light emitting bulb, such that the user may selectively activate the light emitting bulb in accordance with his or her particular desires. It is also oftentimes desirable to have a night light which, without providing a high level of illumination, will significantly aid the user in safely locating objects (including the light switch for the light emitting bulb) within a darkened room. It is also known that electroluminescent light sources can provide a desired degree of light, in several different colors, with little power drain. Thus, while the prior art has generally appreciated both the desire to have a functional, low power drain, and aesthetically pleasing night light, it has not heretofore been known to utilize the advantageous features of an electroluminescent light source in conjunction with the circuitry to the light emitting bulb in order to provide a light fixture which combinedly includes the light emitting bulb and electroluminescent light source.

SUMMARY OF THE INVENTION

The present invention provides a light fixture which includes a light emitting bulb, at least one pair of conductors for connection to an electrical energy source (e.g., typically the household alternating current source), at least one electroluminescent light source, and a switch means for interconnecting these components. The electroluminescent light source, which may be of the type described in U.S. Pat. Nos. 3,069,579 and 5,485,355 is preferably an elongated flexible member which can be readily shaped into a desired configuration. The color of the light emitted by the electroluminescent light source when it is appropriately energized depends essentially on the type of electroluminophor powder used.

The electroluminescent light source includes a pair of conductive electrodes. In accordance with the present invention, one of the electrodes is in a circuit including the switch means which is connected between the light emitting bulb and the electrical energy source. The switch means is manually operative to selectively energize desired ones of the light emitting bulb and/or electroluminescent light source. The light fixture may advantageously be in the form of a table lamp. Various arrangements of the switch means and associated circuitry may be utilized such that (a) the electroluminescent light source will always be on when the unit is connected to an electrical energy source, with the switch means manually turning the light emitting bulb either on or off, or (b) the switch means can alternatively (i) turn the electroluminescent light source on, (ii) the light emitting bulb on, (iii) both the electroluminescent light source and light emitting bulb on, or (iv) both electroluminescent light source and light emitting bulb off.

The electroluminescent light source which is preferably an elongated flexible member, may include a plurality of such individual electroluminescent light sources, each emitting a different color when suitably energized.

As a further feature of the present invention, a photoelectric cell may be included in the circuitry which includes the electroluminescent light source. The photoelectric cell will function to only permit the electroluminescent light source to be turned on in a darkened room. Thus, if the electroluminescent light source portion of a light fixture is intended to serve as a night light, it will not be energized during daylight conditions. This results in reduced power drain and longer life.

Accordingly, it is the primary object of the present invention to provide a light fixture which advantageously combines the functions of a light emitting bulb and electroluminescent light source.

A further object of the present invention is to provide such a light fixture in which the electroluminescent light source will provide a minimal power draw night light.

An additional object of the present invention is to provide such a light fixture which includes a manually operable switch means for the user to selectively energize desired ones of the light emitting bulb and/or electroluminescent light source.

Yet a further object of the present invention is to provide such a light fixture which includes a photoelectric cell such that the electroluminescent light source night light will only be energized in a darkened environment.

These as well as other objects of the present invention, will become apparent upon a description of the following drawings in which:

BRIEF DESCRIPTION OF THE DRAWINGS

FIG. 7 is an alternate circuit diagram in which the switch either only turns the electroluminescent light source on, or turns only the light emitting bulb on.

DETAILED DESCRIPTION

Figure 1:
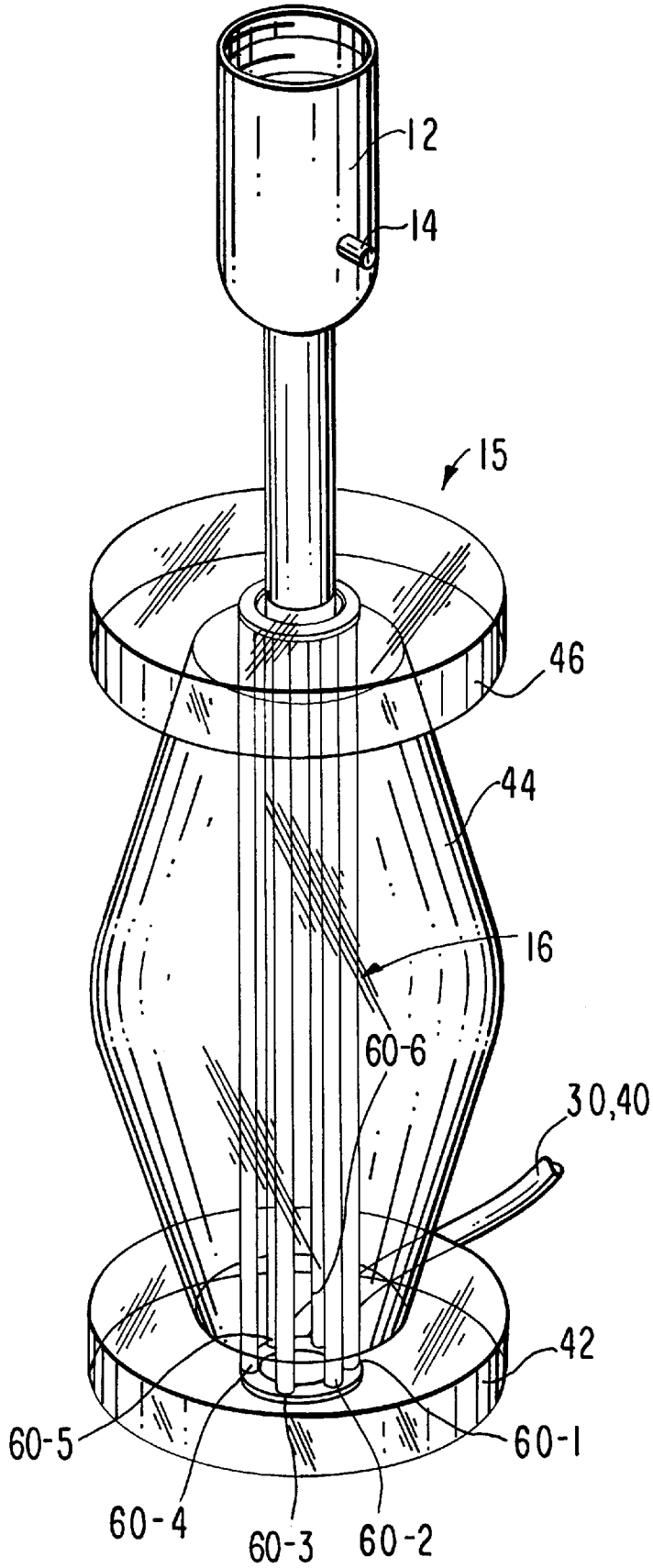
FIG. 1 is a perspective view of one form of a table lamp light fixture in accordance with the present invention.
Figure 2:
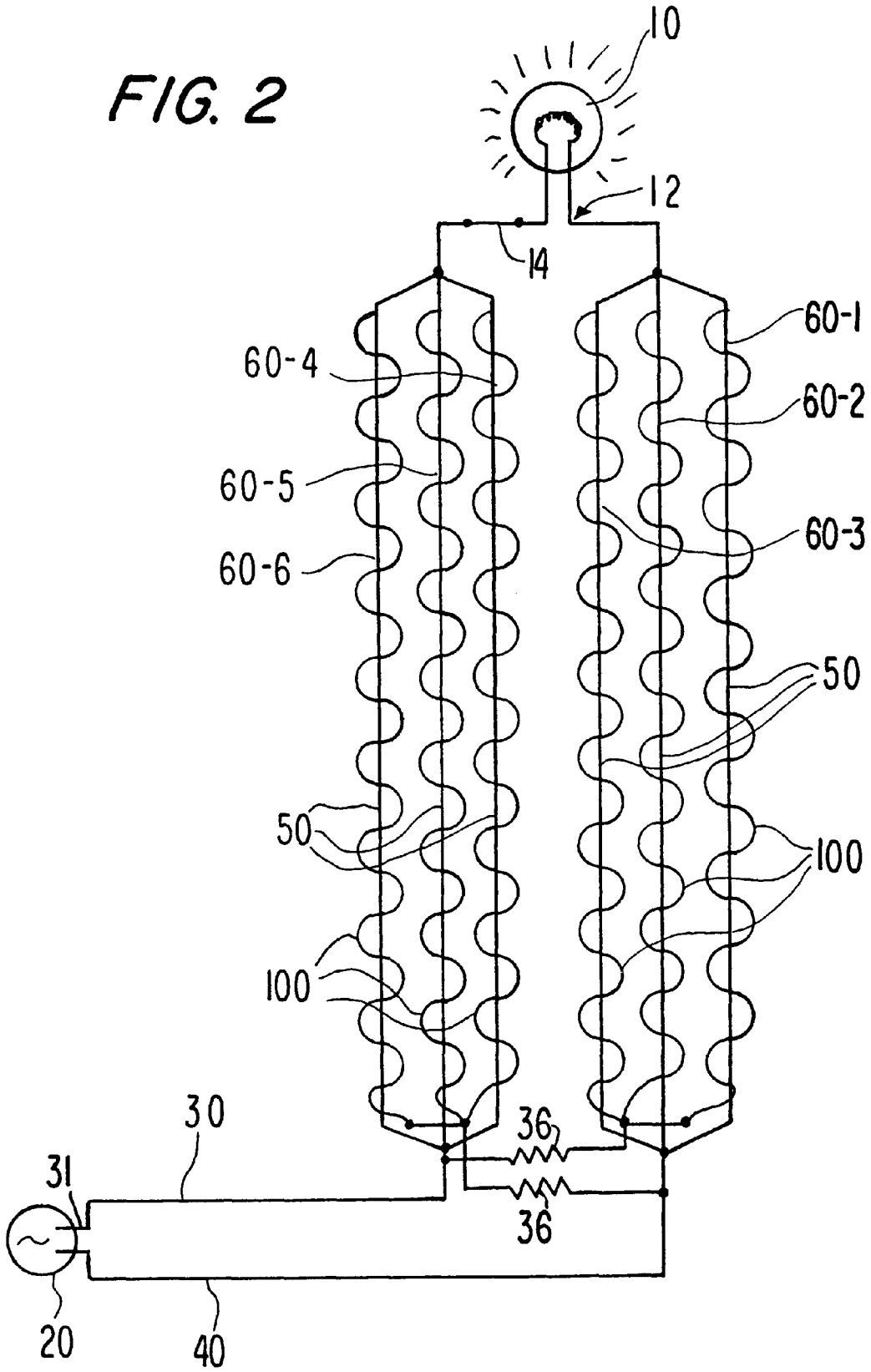
FIG. 2 is a circuit diagram of the light fixture shown in FIG. 1.

Reference is initially made to FIGS. 1 and 2 which illustrate one form of a combined table lamp and night light 15 in accordance with the present invention. It includes a conventional socket 12 for the reception of a bulb 10 and an on/off switch 14. A plurality of electroluminescent light sources 60-1, 60-2, 60-3, 60-4, 60-5, and 60-6 are incorporated within elongated central post-like member 16. The lamp 15 further includes a base 42, decorative transparent enclosure 44, and upper decorative disk like member 46. Although six such electroluminescent light sources are shown, in parallel electrical connection, a different number may be used. Each of the electroluminescent light sources is preferably of the type shown in U.S. Pat. Nos. 5,485,355 and 3,069,579 and includes a central wire 50 which serves as the internal electrode. An electroluminescent layer coats this wire, with an external transparent electroconductive layer overlaying the electroluminescent layer. A wire 100 which is substantially thinner than central wire 50 is in contact with the transparent electroconductive layer by being wound thereover. Wire 100 serves as the second external electrode of the electroluminescent light source. Each individual electroluminescent light source (60-1 through 60-6) is coated with a transparent protective polymer layer so as to provide an elongated flexible cable which is generally in the order of 1.0–3.0 mm in diameter. When the internal and external electrodes are connected to an alternating current power source 20, as by supply line wires 30, 40, the electroluminescent light source will emit light over its entire length, uniformly in all directions. As is well known, the color of the light can be changed by the selection of electroluminophor powder used, and dyes added to the polymer protective layer. Advantageously, a resistor 32 which may typically be in the order of 10,000 to 100,000 ohms, may be inserted within the circuit. The utilization of the resistor significantly reduces the risk of potential damage to the electroluminescent light source which might result from voltage spikes in the system or other types of fast electrical transients that could occur in the supply voltage 20.

It should thus be appreciated that when the lamp 15 is connected to the power source 20, as by plug 31 at the end of supply line wires 30, 40, all six of the electroluminescent light sources 60-1 through 60-6 will be energized. The light emitting bulb 10 may then be selectively energized by the manual movement of switch 14 of the bulb socket 12.

Figure 3:
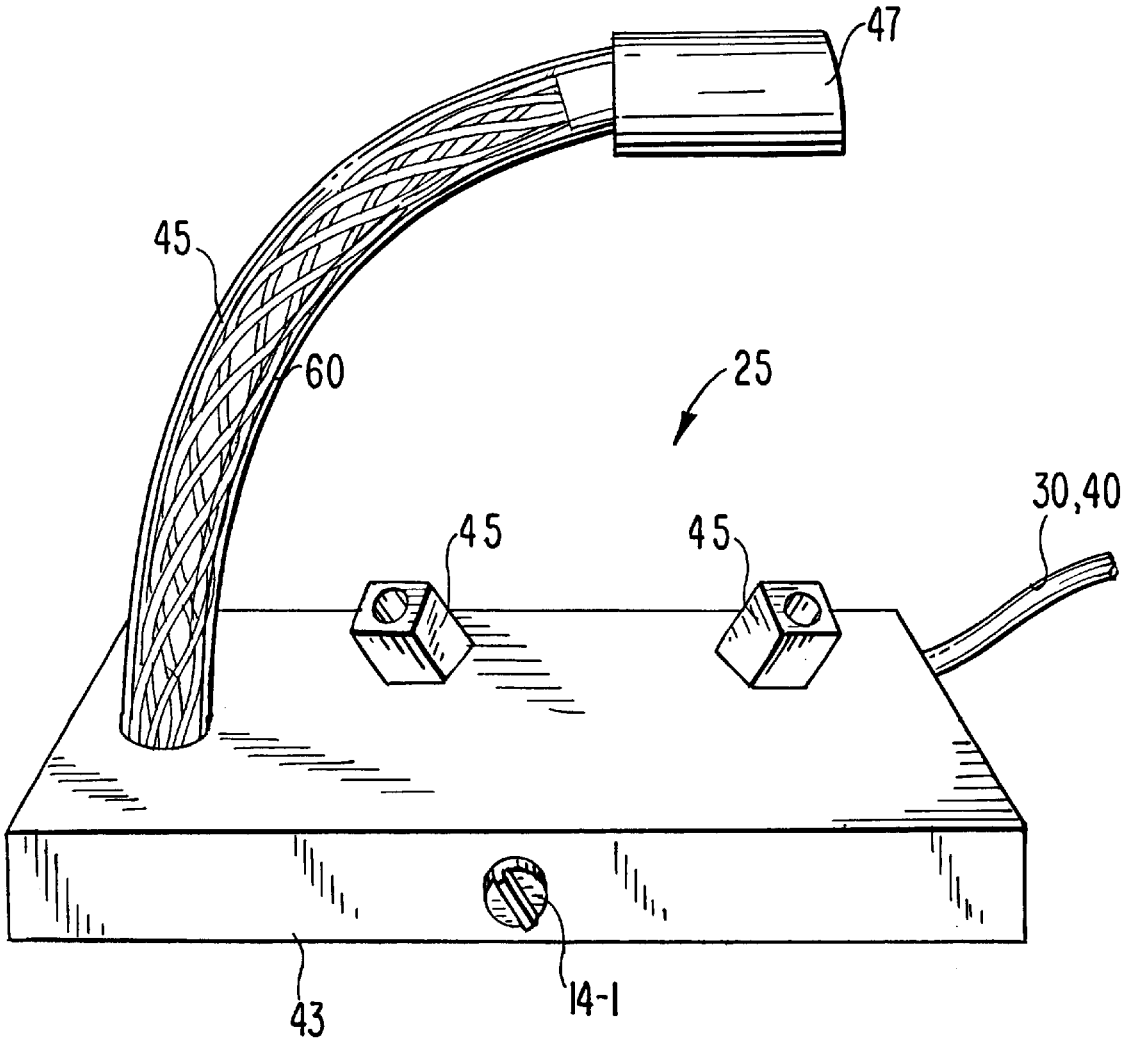
FIG. 3 is a perspective view of another form of light fixture, shown as a desk set, which may be electrically similar to the embodiments of FIGS. 1 and 2.

Reference is now made to FIG. 3 which shows another embodiment of the light fixture, in the form of a desk set 25. The desk set includes a base 43 having receptacles 45, typically for the insertion of a pen and pencil (not shown). The light fixture portion thereof is provided by gooseneck type transparent element 48, which includes an electroluminescent light source 60 contained therein, with the light emitting bulb (not shown) being within shield portion 47. The electroluminescent light source 60 will preferably include a plurality of elongated electroluminescent light sources, such as 60-1 through 60-6 of the prior embodiment. The switch 14-1 corresponding to switch 14 of the embodiment shown in FIG. 1, is located within the base 43. Thus, when the desk set 25 is connected to the power source 20, the electroluminescent light source 60 will be energized, with switch 14-1 then being manually controlled to selectively turn the light emitting bulb on or off.

Figure 4:
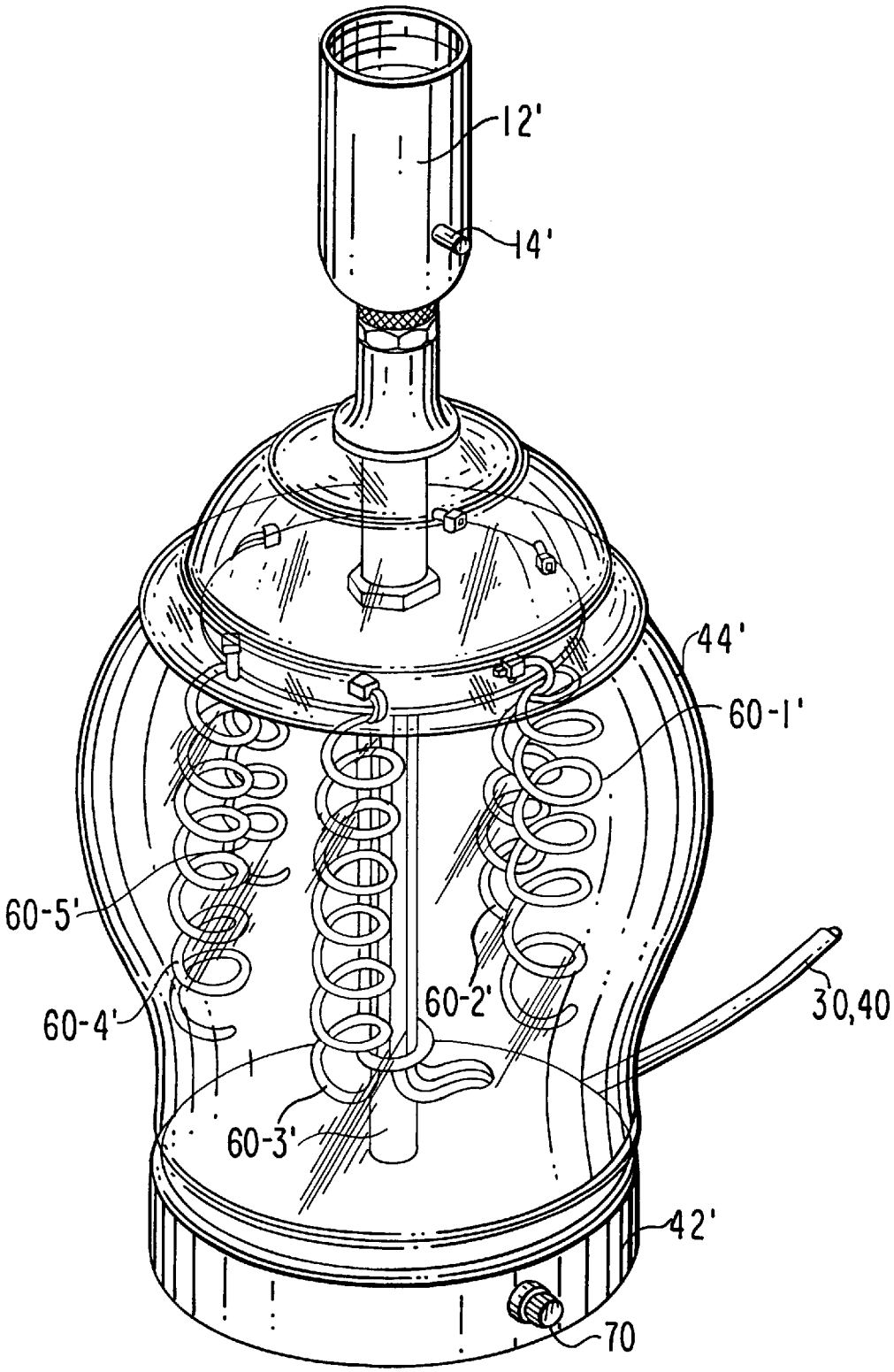
FIG. 4 is a perspective view of another embodiment of a table lamp in accordance with the present invention.
Figure 5:
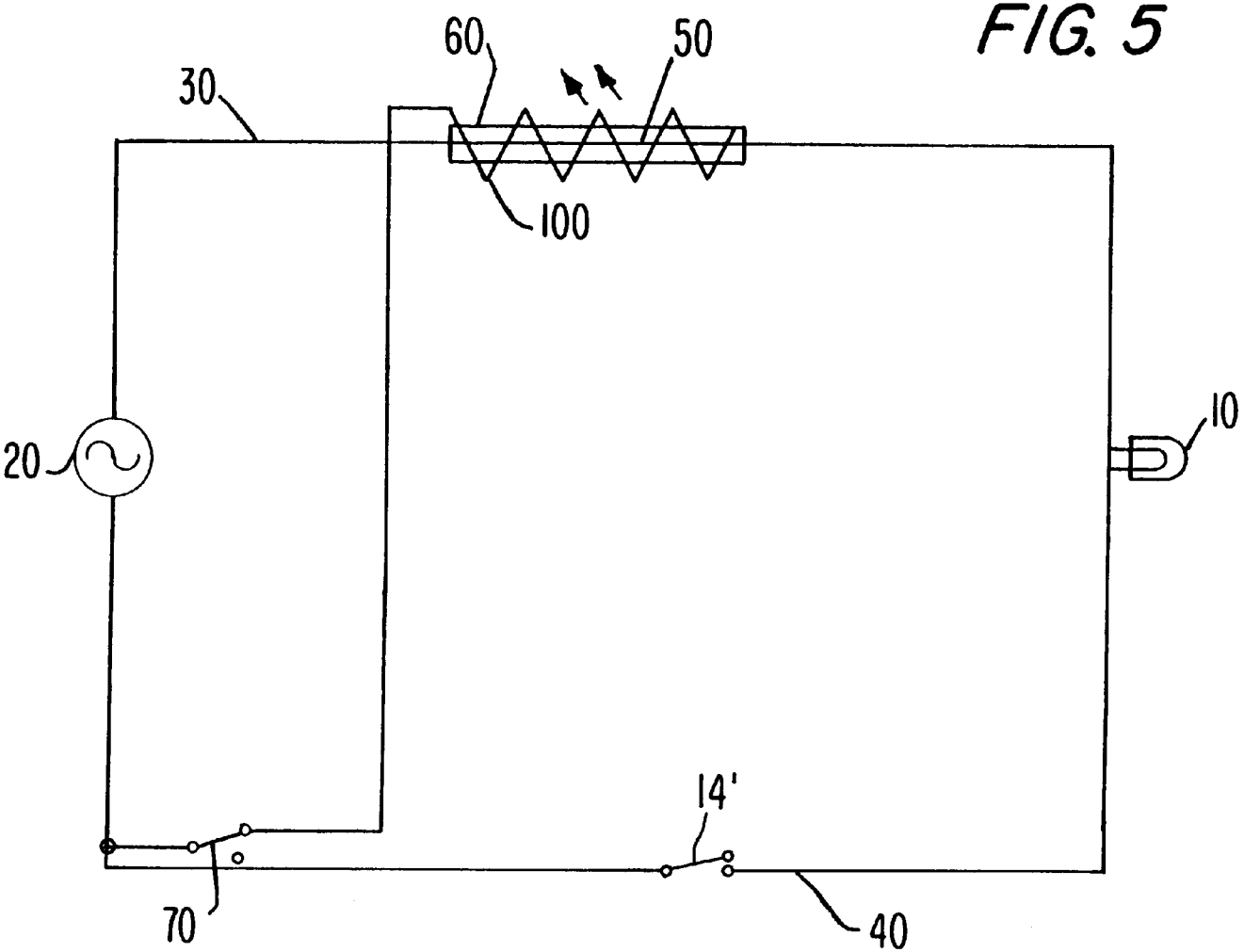
FIG. 5 is a circuit diagram of the table lamp shown in FIG. 4.

Reference is now made to FIG. 4 which shows another embodiment of a table lamp, and in which those components corresponding to similar components of the embodiment shown in FIG. 1 are indicated by the same numerals with a prime suffix. The circuit in FIG. 5 for the light fixture shown in FIG. 4 differs from the prior embodiments in that an additional switch 70 is provided for the electroluminescent light sources 60-1' through 60-5'. That is, the electroluminescent light sources 60-1' through 60-5' may be independently turned on or off by switch 70 such that the electroluminescent light sources 60-1' through 60-5' may be either energized or de-energized, when switch 14' is in either of its two positions (for energizing or de-energizing the light emitting bulb 10).

Figure 6:
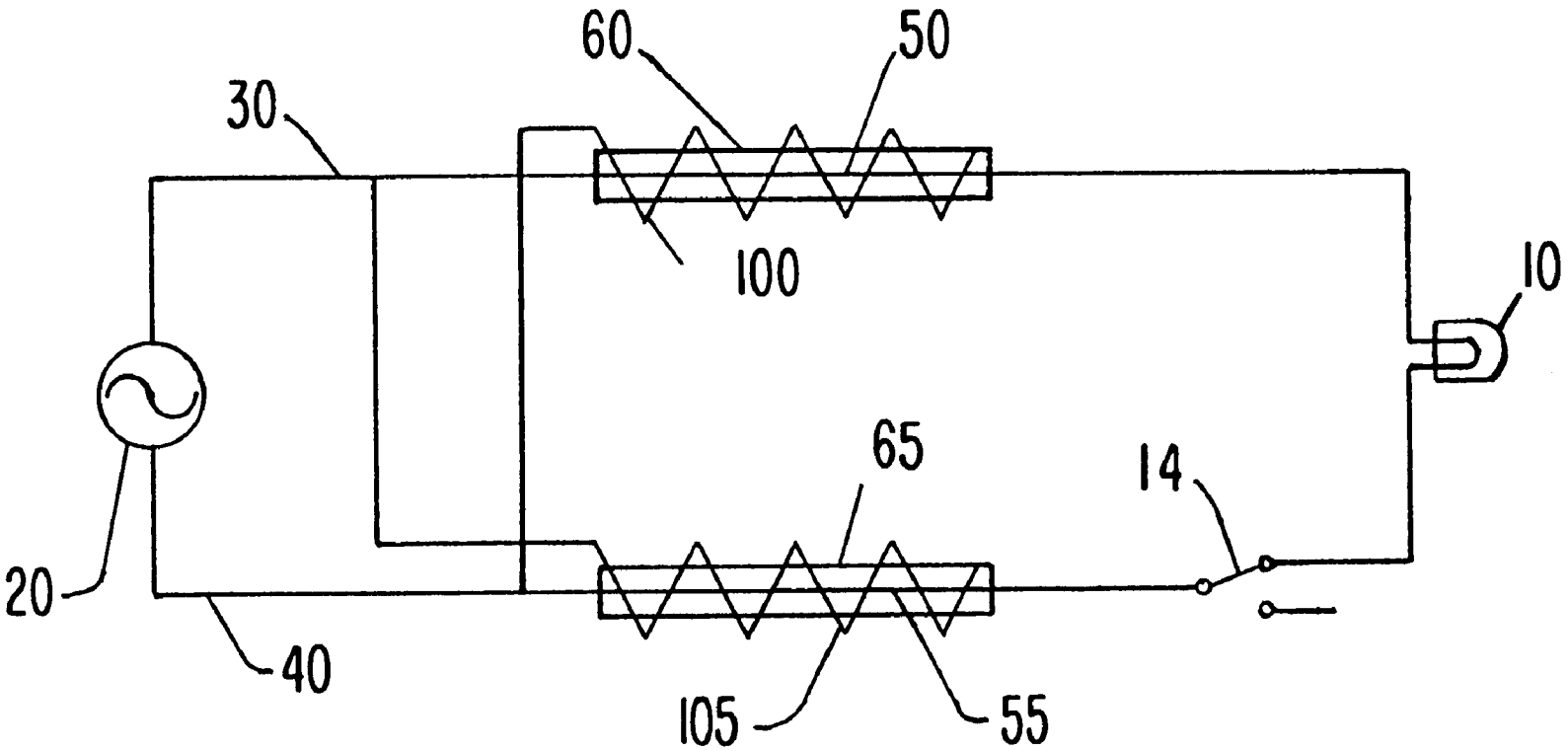
FIG. 6 is a circuit diagram operationally similar to FIG. 2.

FIG. 6 similarly corresponds to FIG. 2, but shows two electroluminescent light sources 60, 65 connected in parallel and continually energized by voltage source 20, via supply line wires 30, 40. Electroluminescent light source 65 includes internal electrode 55 and second external electrode 105. The switch 14 is manually operable to selectively energize light emitting bulb 10.

Figure 7:
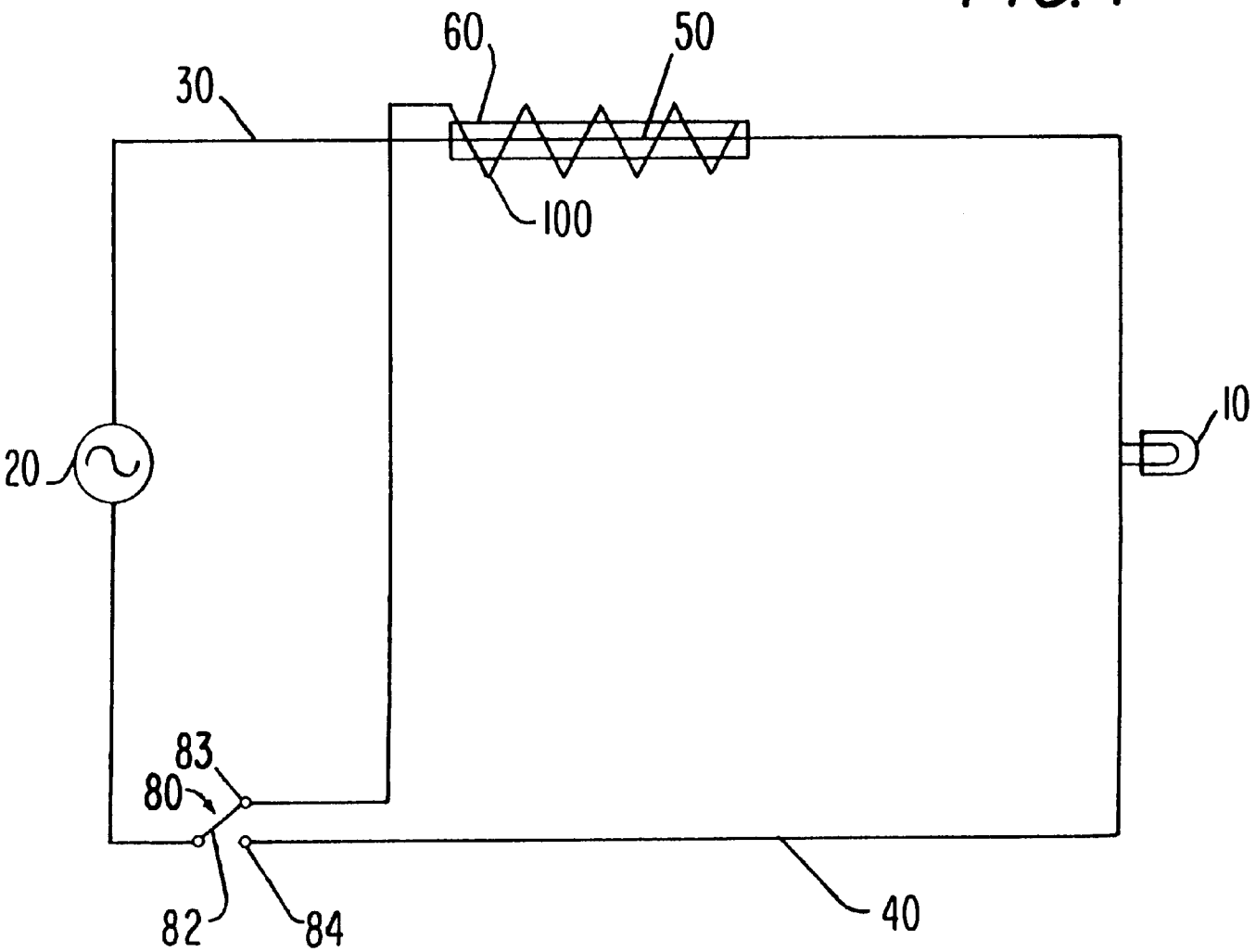

FIG. 7 is a modification of the circuit, shown with only one electroluminescent light source 60 (although it should be understood that additional electroluminescent light sources may be connected thereto in parallel arrangement, as shown in the prior embodiments). The switch 80 is shown as a two position switch. When the common arm 82 is connected to terminal 83, as shown in FIG. 7, only the electroluminescent light source 60 will be energized. When the common arm 82 of the switch is connected to terminal 84, only the light emitting bulb 10 will be energized. Thus, the circuit in FIG. 7 selectively energizes either the electroluminescent light source 60 or light emitting bulb 10.

Figure 8:
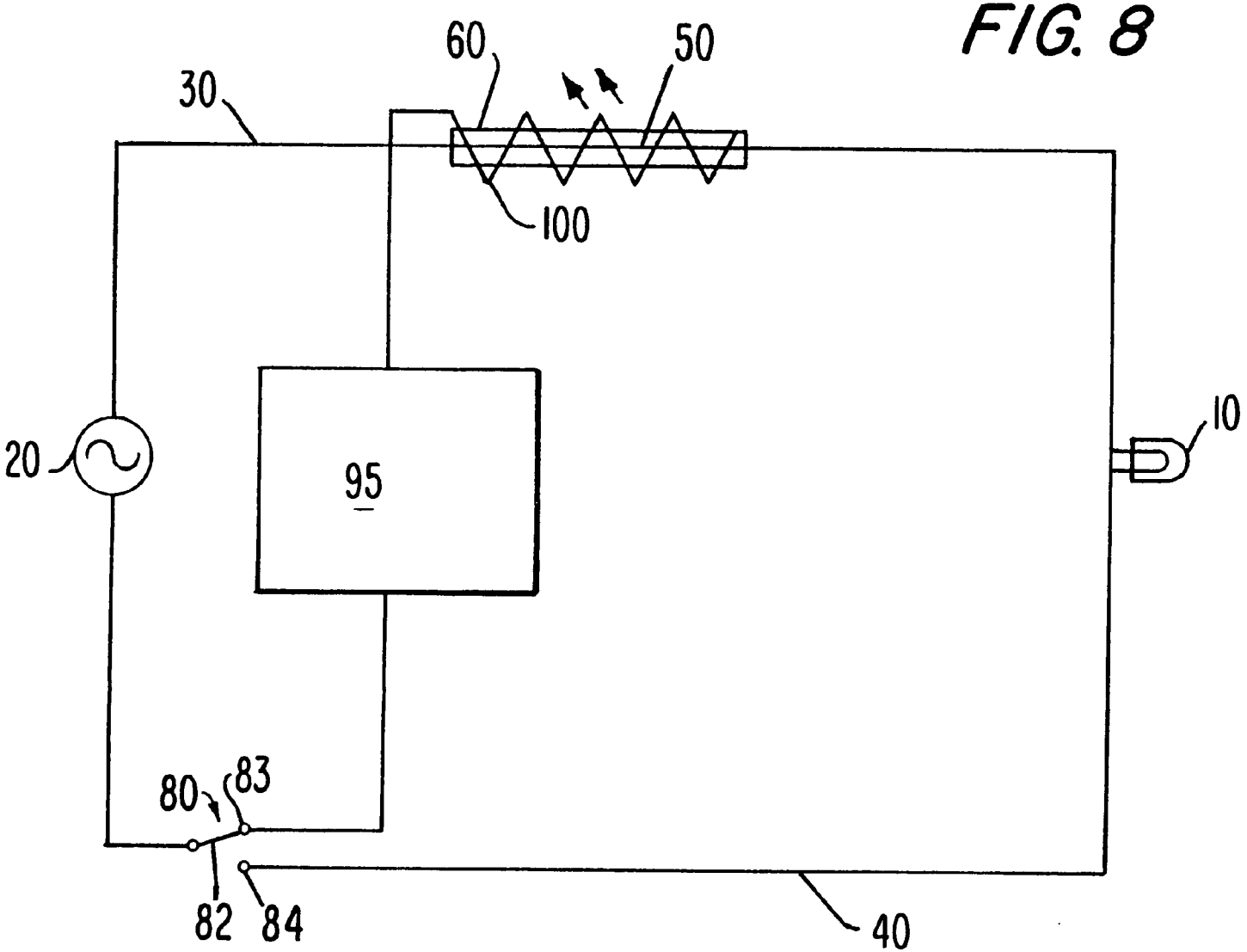
FIG. 8 is a modification of the circuit shown in FIG. 7, which further includes a photoelectric cell in conjunction with the energization of the electroluminescent light source.

FIG. 8 is a variation of the circuit shown in FIG. 7. A photosensitive cell 95 is added in the circuit to the electroluminescent light source 60. This advantageously will limit the completion of the circuit to, and hence energization of, the electroluminescent light source 60 only under darkened ambient conditions.

Figure 9:
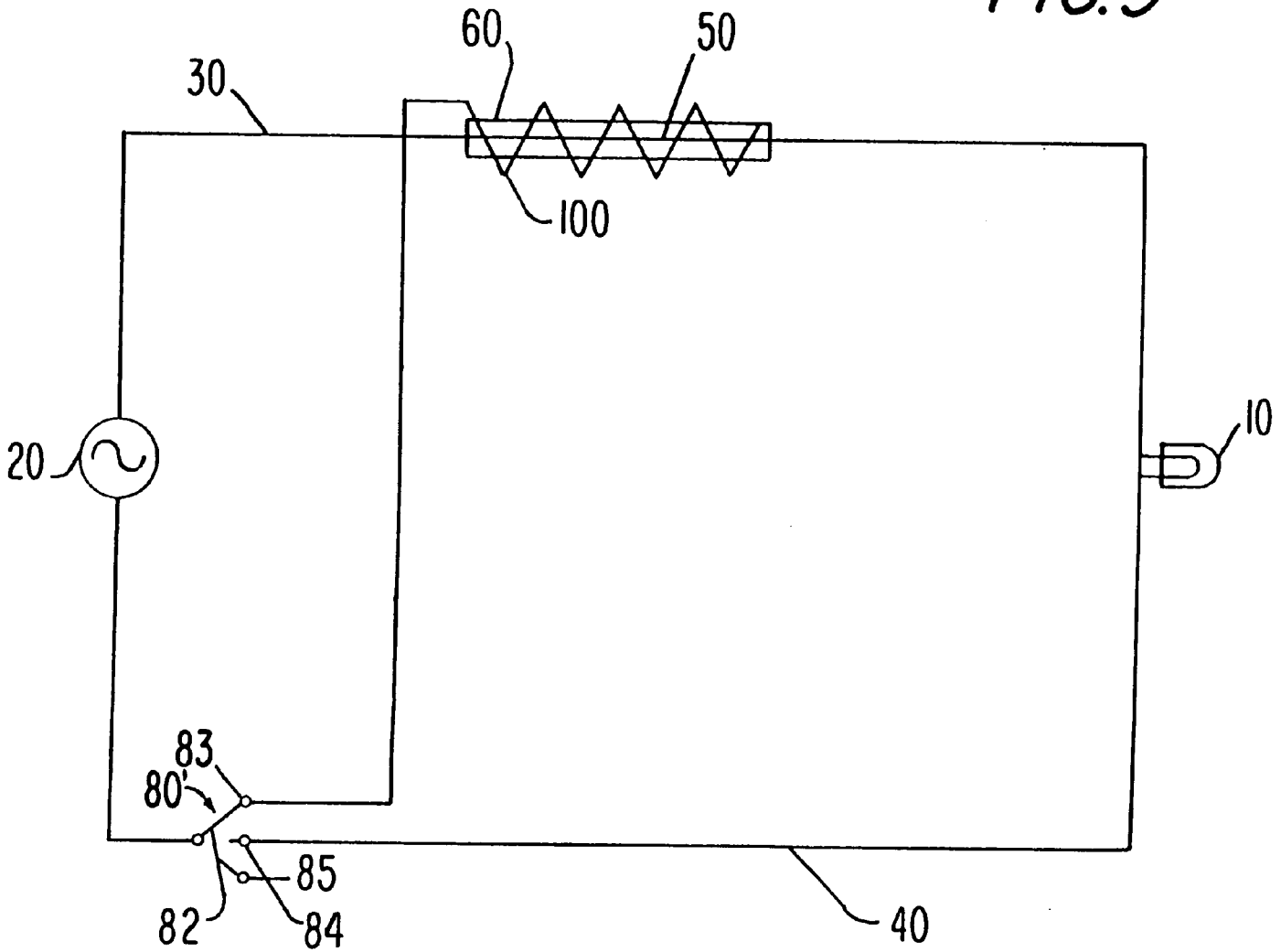
FIG. 9 is a modification of the circuit shown in FIG. 7 in which the switch includes an additional position for turning both the electroluminescent light source and light emitting bulb off.

FIG. 9 is a modification of the circuit shown in FIG. 7, in that switch 80' includes an additional position 85. When the common arm 82 is connected to switch terminal 85 neither the electroluminescent light source 60 or light emitting bulb 10 will be energized. Thus, this circuit selectively energizes either the electroluminescent light source 60, light emitting bulb 10, or neither of them.

Figure 10:
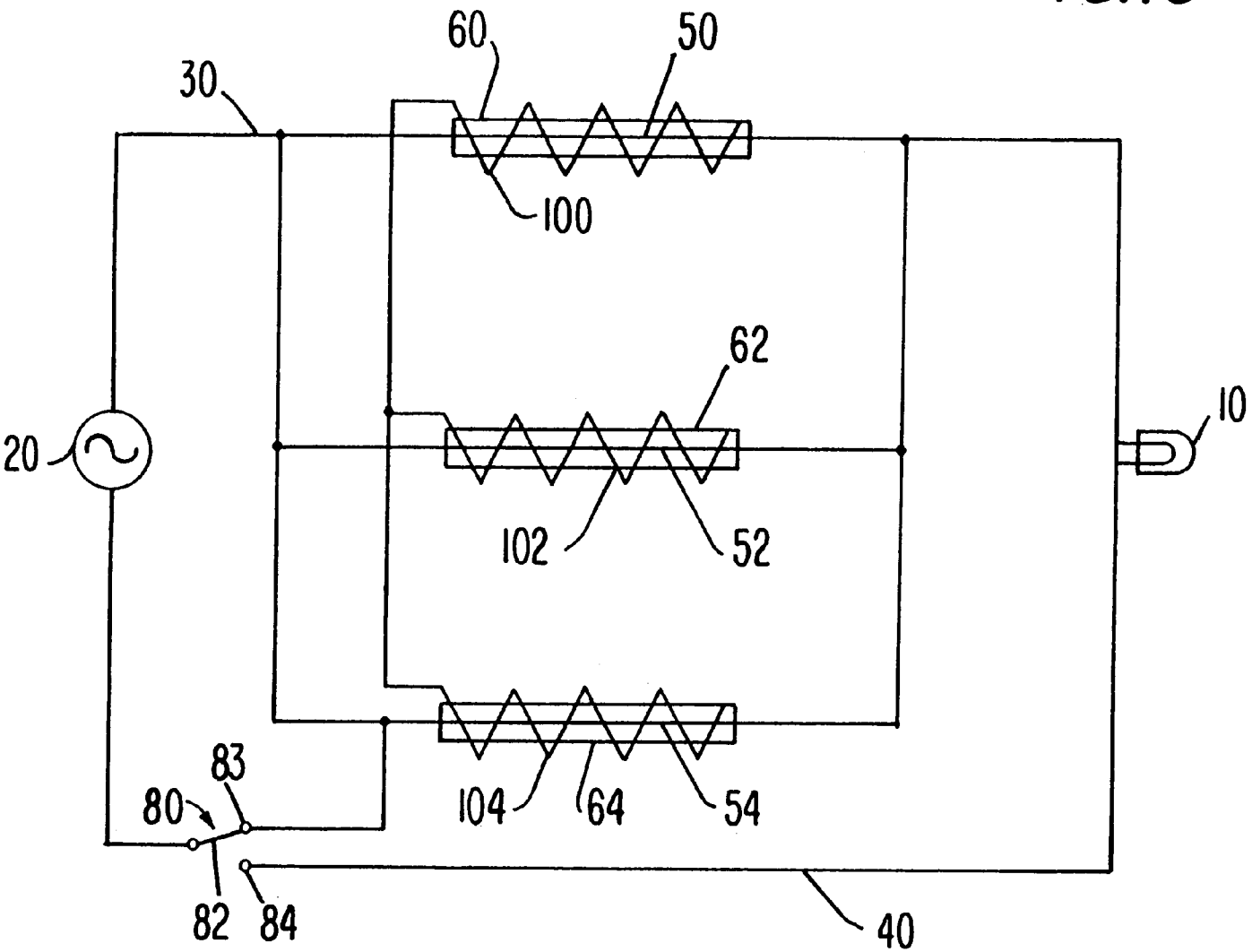
FIG. 10 is a modification of the circuit shown in FIG. 7, which includes three electroluminescent light sources in electrical parallel connection.

FIG. 10 corresponds to the circuit of FIG. 7, but shows three electroluminescent light sources 60, 62, and 64 (having conductors 50, 100; 52, 102; 54, 104, respectively) connected in parallel.

It is therefore seen that the present invention provides a light fixture in which one or more electroluminescent light sources are combined with the light emitting bulb. This advantageously permits the unit to operate as a night light in addition to a source of more substantial illumination. Several embodiments are provided to selectively control the functioning of the light emitting bulb and electroluminescent light source.

While several preferred embodiments of the present invention have been described in detail, various modifications, alterations, and changes may be made thereto without departing from the spirit and scope of the present invention as defined in the following claims:

What is claimed is:

1. An illuminated night-lamp comprising a housing with a socket, an electric bulb, said socket being adapted to receive said electric bulb, at least two current-carrying wires, an electrical energy source, and a at least two-positional switch, a portion of at least a first of said at least two current-carrying wires serving as an internal electrode of a cable-like electroluminescent light source, said first current-carrying wire being connected at a first end to one of the leads of an electrical supply line, and said first current-carrying wire being connected at a second end to said electric bulb, a second of said at least two current-carrying wires being connected at a first end to another lead of the electrical supply line, said second current-carrying wire being connected at a second end to said first current-carrying wire, an external electrode of said electroluminescent light source being electrically connected to one of said at least two current-carrying wires other than said onecurrent-carrying wire on which said external electrode is located, said electroluminescent light source being enclosed within a transparent part of said housing to provide a source of illumination, said switch selectively turning said electric bulb between an on and off condition.

2. An illuminated night lamp according to claim 1, further comprising at least another electroluminescent light source and wherein a portion of at least two of said at least two current-carrying wires serve as said internal electrodes of said electroluminescent light sources, an external electrode of a first of said electroluminescent light sources being located on one of said current-carrying wires and being directly electrically connected with said second current-carrying wire, and an external electrode of a second of said electroluminescent light sources being located on another of said current-carrying wires and being directly electrically connected with said first current-carrying wire, both said first and second current-carrying wires being directly electrically connected with respective leads of the electrical supply line, and said switch being incorporated between said electric bulb and said electrical energy source.

3. An illuminated night lamp according to claim 1, further comprising at least another electroluminescent light source and wherein each of said external electroluminescent light source electrodes is electrically connected to a respective current-carrying wire through an electrical resistance.

4. An illuminated night lamp according to claim 1, wherein said first current-carrying wire is directly electrically connected with said one of said leads of the electrical supply line, and said second current-carrying wire is connected to said another lead of the electrical supply line through said switch, one terminal of said switch being electrically connected to said second current-carrying wire, and another terminal of said switch being electrically connected to said external electrode of said electroluminescent light source.

5. An illuminated night lamp according to claim 4, wherein a photosensitive switch is incorporated between the external electrode of said electroluminescent light source and a terminal of said switch.

6. An illuminated night lamp according to claim 1, further comprising at least another electroluminescent light source and wherein a portion of at least one of said at least two current-carrying wires comprises a plurality of said internal electroluminescent light source electrodes emitting light of different colors connected in parallel, and the external electrodes of all these electroluminescent light sources are electrically connected.

7. A light fixture combining dual functions of an illuminating device and a night lamp, said fixture comprising:

an illuminating device including a socket for electrically receiving a light emitting bulb, a switch for turning the bulb on and off, and first and second conductors for connection to an electrical energy source; and a night lamp including an electroluminescent light source having an internal electrode, wherein an extended portion of said first conductor serves as the internal electrode of said light source.

8. The fixture of claim 7, wherein said electroluminescent light source includes an external electrode, said external electrode having a first end electrically connected to said second conductor and a second end electrically connected to an element selected from the group consisting of the bulb and said switch.

9. The fixture of claim 7, wherein said switch is operative in a first position and a second position, said first position being for energizing the bulb and said second position being for placing the bulb in a de-energized condition, wherein said electroluminescent light source is energized at all times that said first and second conductors are connected to the electrical energy source regardless of a position of said switch.

10. The fixture of claim 7, wherein said switch is operative in a first position and a second position, said first position being for energizing the bulb while placing said light source in a de-energized condition, and said second position being for energizing said light source while placing the bulb in a de-energized condition.

11. The fixture of claim 10, wherein said switch is operative in a third position for placing both the bulb and said light source in their de-energized conditions.

12. The fixture of claim 7, further comprising a second switch having a first position for turning said light source on and a second position for turning said light source off, said second switch turning said light source on and off independently of an on/off condition of the bulb.

13. The fixture of claim 7, further comprising a photosensitive cell for detecting a darkened ambient condition, said photosensitive cell being connected to said light source to permit energization of said light source only when said photosensitive cell detects the darkened ambient condition.

14. The fixture of claim 7, wherein said electroluminescent light source includes an external electrode and a second switch for turning said light source on and off, said external electrode having a first end electrically connected to said second switch and a second end electrically connected to an element selected from the group consisting of the bulb and the first-mentioned switch.

15. A light fixture combining dual functions of an illuminating device and a night lamp, said fixture comprising:

an illuminating device including a socket for electrically receiving a light emitting bulb, a switch for turning the bulb on and off, and a first conductive structure for connection to an electrical energy source to selectively supply power to the bulb; and a night lamp including an electroluminescent light source having a second conductive structure for supplying power to said light source, wherein a portion of said second conductive structure serves as a necessary portion of said first conductive structure.

16. The fixture of claim 15, wherein said switch is operative in a first position and a second position, said first position being for energizing the bulb and said second position being for placing the bulb in a de-energized condition, wherein said electroluminescent light source is energized at all times that said first and second conductors are connected to the electrical energy source regardless of a position of said switch.

17. The fixture of claim 15, wherein said switch is operative in a first position and a second position, said first position being for energizing the bulb while placing said light source in a de-energized condition, and said second position being for energizing said light source while placing the bulb in a de-energized condition.

18. The fixture of claim 17, wherein said switch is operative in a third position for placing both the bulb and said light source in their de-energized conditions.

19. The fixture of claim 15, further comprising a second switch having a first position for turning said light source on and a second position for turning said light source off, said second switch turning said light source on and off independently of an on/off condition of the bulb.

20. The fixture of claim 15, further comprising a photosensitive cell for detecting a darkened ambient condition, said photosensitive cell being connected to said light source to permit energization of said light source only when said photosensitive cell detects the darkened ambient condition.

21. An electrical apparatus combining dual functions of an electrical device and a lamp, said fixture comprising:

an electrical device including an electically-powered component, a switch for turning said component on and off, and a first conductive structure for connection to an electrical energy source to selectively supply power to said component; and a lamp including an electroluminescent light source having a second conductive structure for supplying power to said light source, wherein a portion of said second conductive structure serves as a necessary portion of said first conductive structure.

* * * * *